US007444686B2

(12) United States Patent
Stewart

(10) Patent No.: US 7,444,686 B2
(45) Date of Patent: Nov. 4, 2008

(54) BODY ARMOR CARRIER VEST

(76) Inventor: Dayle Stewart, 1541 Elbridge St., Philadelphia, PA (US) 19149

( * ) Notice: Subject to any disclaimer, the term of this patent is extended or adjusted under 35 U.S.C. 154(b) by 183 days.

(21) Appl. No.: 11/242,381

(22) Filed: Oct. 3, 2005

(65) Prior Publication Data

US 2007/0234459 A1 Oct. 11, 2007

(51) Int. Cl.
*A41D 13/00* (2006.01)

(52) U.S. Cl. ..... 2/102

(58) Field of Classification Search ..... 2/2.5, 2/102, 92, 94, 247, 463; 428/911
See application file for complete search history.

(56) References Cited

U.S. PATENT DOCUMENTS 4,413,357 A * 11/1983 Sacks ..... 2/2.5
5,495,620 A * 3/1996 Schoenweiss et al. ..... 2/2.5
5,495,621 A * 3/1996 Kibbee ..... 2/2.5
6,026,509 A 2/2000 Bachner, Jr.
6,185,738 B1 2/2001 Sidebottom
6,233,737 B1 5/2001 Ditchfield et al.
6,453,791 B1 9/2002 Seitzinger
6,766,529 B1 7/2004 Nathan
6,961,957 B2 * 11/2005 Carlson ..... 2/2.5

* cited by examiner

*Primary Examiner*—Tejash Patel
(74) *Attorney, Agent, or Firm*—Altimatia, LLC; David M. Gange

(57) ABSTRACT

An elastic body armor carrier vest is described. Embodiments of the invention are comprised of a front portion contain at least two pouches adapted to carry ballistic armor and/or trauma plates, and a rear portion comprising at least one pouch adapted to carry ballistic armor and/or trauma plates. Embodiments of the invention are comprised of elastic fabric to provide a cooler, better fitting garment, that holds ballistic armor inserts and trauma plates securely in position, enhancing the comfort and security of the wearer.

13 Claims, 8 Drawing Sheets

BODY ARMOR CARRIER VEST

FIELD

Embodiments of the invention relate to the field of ballistic resistant or bulletproof garments, also know as body armor carrier vests.

BACKGROUND

The need body armor is well know and understood. Body armor, ballistic resistant vests, and bulletproof vests are used to prevent gunshot wound trauma and preserve the life of the wearer. Many types of body armor have been described in prior patents, for example, U.S. Pat. No. 6,766,529, U.S. Pat. No. 6,453,791, U.S. Pat. No. 6,233,737, U.S. Pat. No. 6,185,738, U.S. Pat. No. 6,029,270, U.S. Pat. No. 6,026,509, U.S. Pat. No. 5,327,811, and U.S. Pat. No. 3,973,275;; which are hereby incorporated herein by reference.

While the usefulness of body armor is unquestioned, problems remain. Body armor is generally comprised of a carrier garment, such as a vest, with pouches, and ballistic armor that is placed into the pouches. Ballistic armor may be flexible or rigid, and in a working vest both types of armor may be used. Because carrier vests are generally constructed of non-elastic fabrics there is little give in the garments. The vests fit poorly, and have a tendency to ride up the body of the wearer. In addition, vest garments tend to be heavy, hot, and uncomfortable for the wearer. A typical vest is described in U.S. Pat. No. 6,185,738. The '738 vest comprises front and back portions that held on the wearer's body through the use of hook-and-loop fasteners. While such a vest may fit well when first placed on the body, it's non-elastic fabric lacks the ability to conform to the movements of the body. When the wearer sits, the bottom of the vest may curl up. If vest bottom curling becomes permanent, ballistic protection may be lessened. When the wearer engages in a physical activity such as running, or when a police officer wrestles with a suspect, the hook-and-loop fasteners may come loose, lessening protection when it is most needed. In addition, armor panels may come loose during vigorous physical activity, again lessening protection when it is most needed by the wearer. Therefore, a need remains for an improved body armor carrier vest which addresses the problems of current carrier vests. A better fitting, lighter, cooler carrier vest designed to securely maintain ballistic armor in position would be of great benefit to wearers, particularly law enforcement and military personnel.

SUMMARY

Embodiments of the invention provide an improved body armor carrier vest comprised of an elastic fabric. Elastic fabrics such as LYCRA®, SPANDEX®, DuPont COOLMAX®, DoubleTex® TruFlex™ or other elastic fabrics may be used. Elastic fabrics may be used alone or in combination with other materials such as cotton. Such materials are elastic, cool, and light weight. When garments made of elastic fabrics are worn, the garments stretch to fit the wearer's body providing improved fit. These form fitting fabrics and garments also provide support to the wearer, helping to minimize fatigue in the wearer.

The use of elastic fabric in embodiments of the invention also improves the ability of vests of the invention to remain on the body of the wearer during vigorous physical exercise, such as running, or wrestling with adversaries. Fasteners on inelastic vests may come undone during vigorous physical activity. Because the fabric of vests of the invention is elastic, when the wearer stretches, bends, twists, and turns, the fabric moves with the wearer and lessens the force on the fasteners, reducing the likelihood that the fasteners will come undone. In addition, in preferred embodiments of the invention the area of hook and loop fasteners used is large, providing a stronger fastening force and again reducing the likelihood of the fasteners coming undone.

Embodiments of the invention provide an improved fit for women, particularly women possessing a generous bust. A close fitting vest may tend to force breast tissue outwards towards the arms of the female wearer, resulting in unsightly bulging and exposing a sensitive body area to potential harm. Embodiments of the invention provide extra elastic material, or elastic bands, that keep breast tissue safely behind the carrier vest. The extra elastic material used in women's vests provides improved fit, appearance, and safety for female wearers.

Embodiments of the invention hold both flexible and rigid body armor panels firmly in position through the use of shelf straps and fasteners. After a body armor panel is placed within a pouch of a carrier vest of the invention, the armor may be secured in place with a shelf strap. As illustrated in FIG. 11 a shelf strap is fixedly attached to one side of an armor pouch. The strap is passed below a body armor panel and fastened to the other side of the body armor pouch, thereby holding the body armor panel in place. Embodiments of the invention possess a plurality of pouches including pouches configured to carry trauma plates. Trauma plates, which typically fit into smaller body armor pouches, may be held in place through the use of fasteners located on the top edge of the trauma plate pouch. The use of fasteners along the top edge of a trauma plate pouch prevents the trauma plate from accidentally sliding out of the pouch when the wearer is bending over or otherwise has an inverted body position.

DETAILED DESCRIPTION

Figure 1:
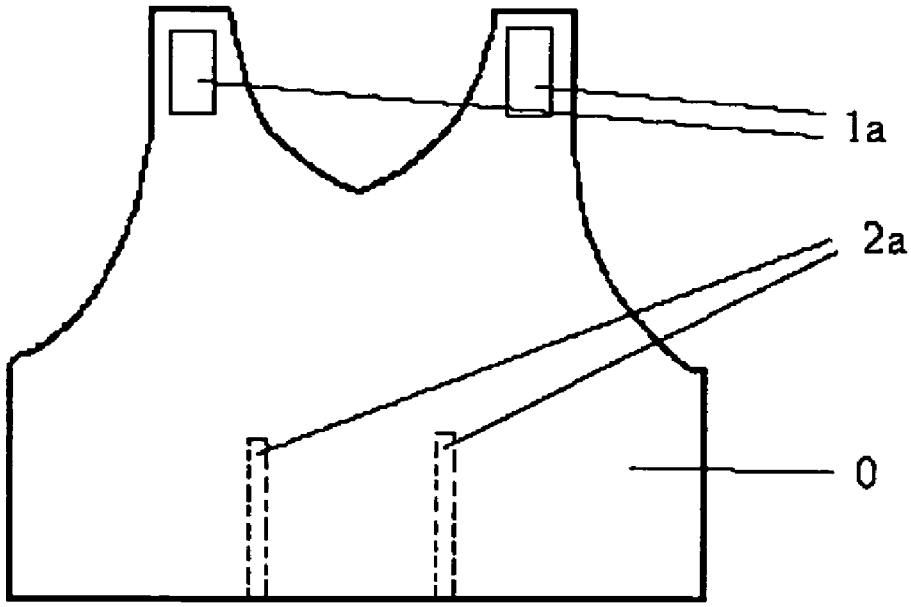
FIG. 1. A plan view drawing of the exterior-facing side of the front outside portion (0) of a vest of the invention showing location of shoulder fasteners (1*a*) and pouch facing shelf strap fasteners (2*a*).

As used herein Elastic Fabric refers to stretchable fabrics such as DuPont LYCRA®, SPANDEX® and blends of fabrics such as LYCRA® or SPANDEX® blended with cotton, wool, nylon, polyester, silk, or other fabric. Examples of elastic fabrics include DuPont COOLMAX® and Double-Tex® TruFlex™. TruFlex™ possesses a 12-18% stretchability factor and is a most preferred elastic fabric. Preferred elastic fabrics are LYCRA®/cotton blends or SPANDEX®/cotton blend comprising 2%-50% LYCRA® or SPANDEX®. More preferred elastic fabrics are LYCRA®/cotton or SPANDEX®/cotton blends comprising 2%-20% LYCRA®. Still more preferred elastic fabrics are LYCRA®/cotton or SPANDEX®/cotton blends comprising 2%-6% LYCRA®. Most preferred elastic fabrics are LYCRA®/cotton or SPANDEX®/cotton blends comprising about 3% LYCRA® or SPANDEX®.

As used herein Ballistic Armor or Ballistic Armor Insert refers to flexible body armor which is inserted into body armor carrier vests. A variety of flexible ballistic armor inserts are available for use in ballistic armor carrier vests, for example, Second Chance Body Armor Inc. MONARCH®, Allied Signal Co. SPECTRAFLEX®, and Second Chance Body Armor Inc. ARAFLEX®inserts. Flexible ballistic armor is typically comprised of a number of layers of a fabric made from high performance polymers, such as DuPont KEVLAR®, AKZO NOBEL TWARON T-2000®, and Toyobo Co. Ltd. $ZYLON_{198}$®.

As used herein Trauma Plate refers to ceramic ballistic armor, or metallic ballistic armor, such as steel ballistic armor. Trauma plates provide a higher degree of ballistic protection and are typically used to provide additional coverage to vital body areas, such as the heart.

As used herein Attached means removably attached or temporarily attached, such as when two pieces of fabric are attached to one another by means of hook and loop fasteners (VELCRO®), buttons, metal snap fasteners, zippers, metal snap fasteners, or other temporary attaching means.

As used herein Fixedly Attached means permanently attached. Fixed attachment may be achieved through sewing, gluing, stapling, riveting, fusing, or other permanent attaching means.

As used herein Fastener or Fastening Means refers to devices or means for attaching one portion of material or fabric to another portion of material or fabric. Fasteners and fastening means are comprised of complementary portions; the complementary portions of fasteners and fastening means are typically located opposite one another on complementary portions of fabric. Examples of fasteners and fastening means include hook and loop fasteners, such as VELCRO®, metal snap fasteners, button-buttonhole fasteners, metal zippers, plastic zippers, such as nylon zippers, and safety pins, Embodiments of the invention are body armor carrier vests comprised of elastic fabric. Elastic fabric provides several advantages to the wearers of vests of the invention. It is lightweight, breathable, and therefore comfortable to wear. The elasticity of the fabric allows vests of the invention of fit the body closely, enhancing wearer comfort and appearance. In addition, the elasticity of vests of the invention helps to secure body armor inserts in position. The elastic flexibility of vests of the invention enhances the ability of the vests to remain securely on the body of the wearer during physical exertion. During heavy physical exertion, such as running or twisting or bending or wrestling with another person, non-flexible fabrics may exert enough force on vest fasteners, such as VELCRO® fasteners, to undo the fasteners, leading to a loss of body armor protection when it is most needed.

Embodiments of the invention comprise a vest front and a vest rear fastened to one another with fastening means. The vest front comprises at least two pouches, a first pouch for carrying ballistic armor and a second pouch for carrying either ballistic armor or a trauma plate. The vest rear comprises at least one pouch for inserting ballistic armor. The vest front and rear are removably attached to one another by fastening means, preferably hook and loop fasteners.

Figure 2:
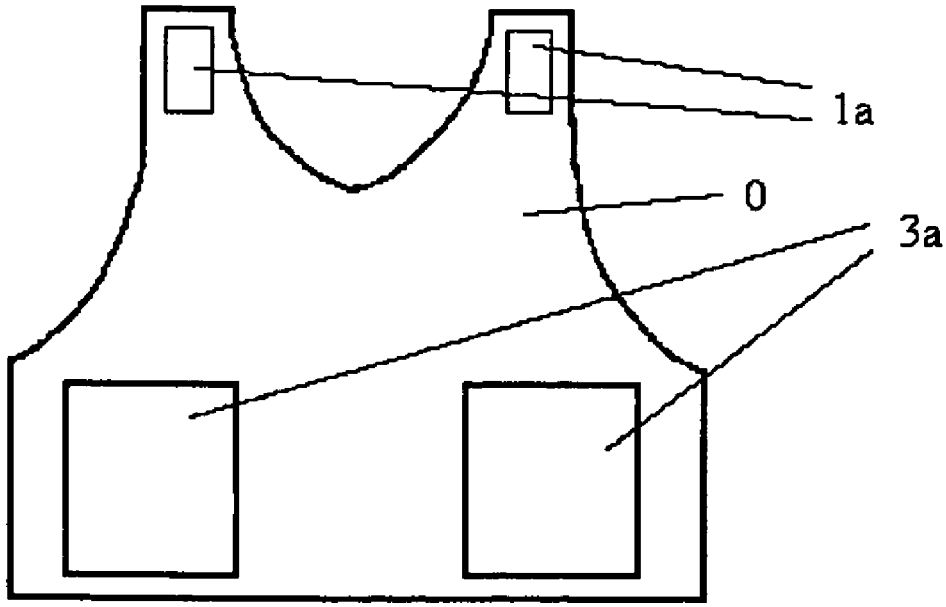
FIG. 2. A plan view drawing of the exterior-facing side of the front outside portion of a vest of the invention showing the location of shoulder fasteners (1*a*) and waist fasteners (3*a*).

The vest front is comprised of a front outside portion, having an exterior-facing side and a pouch-facing side, and a front inside portion, having a body-facing side and a pouch-facing side. One complimentary portion of at least two shelf strap fastening means (2*a*) is fixedly attached to the pouch facing side of the front outside portion as show in FIG. 1. These fastening means will mate with complimentary portions of fastening means of the shelf straps, the straps being used to secure at least one body armor insert in place in the first vest front pouch. In a preferred embodiment the fastening means are hook and loop fasteners. In a most preferred embodiment the hook and loop fastener strips are about ¾ inches wide and about 5-6 inches long. One portion of at least two waist fastening means (3*a*) are fixedly attached to the exterior facing side of the front outside portion of the vest front as shown in FIG. 2. The fastening means (3*a*) shown in FIG. 2 are used to secure the vest front to the vest back. In a preferred embodiment the fastening means are hook and loop fasteners. In a most preferred embodiment the hook and loop fastener areas are between about eight and about thirty-two square inches, preferably between about twelve to about thirty-two square inches. On the shoulder straps of the exterior-facing portion of the front outside portion are fixedly attached fastening means (1*a*) as shown in FIGS. 1 and 2. The fastening means (1*a*) are used to secure the shoulder straps of the vest front to the shoulder portions of the vest rear. In a preferred embodiment the fastening means (1*a*) are hook and loop fasteners such as VELCRO® or the like. In a most preferred embodiment the hook and loop fastener strips are about two inches wide and about four to six inches long.

Figure 3:
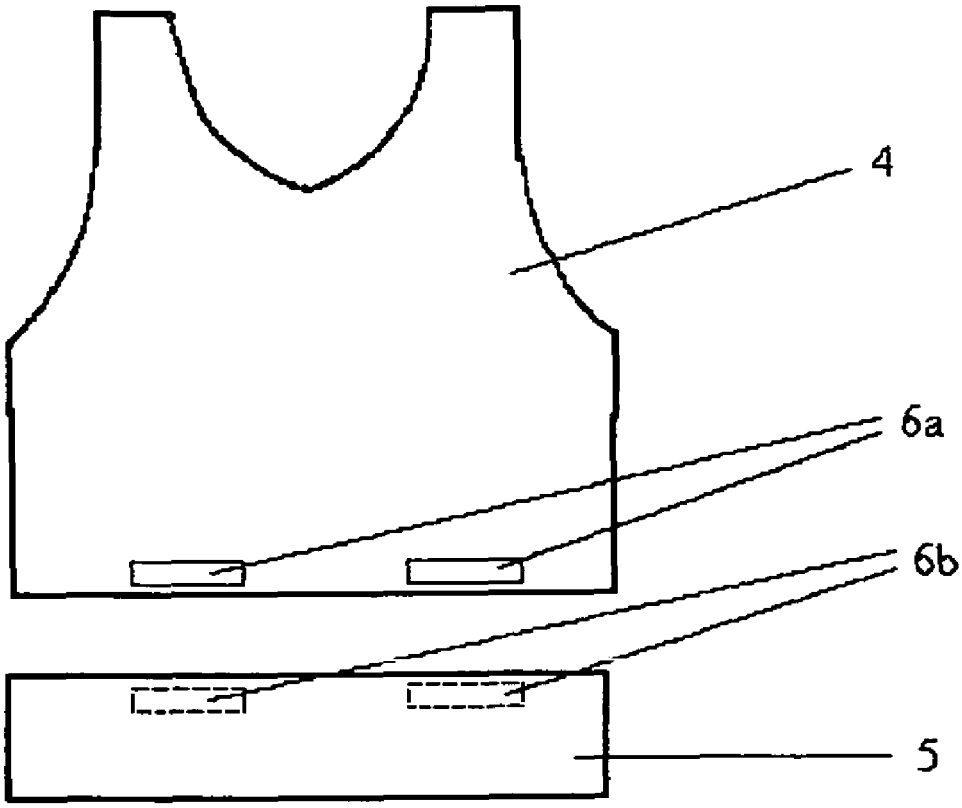
FIG. 3. A plan view drawing of the pouch-facing side of the front inside portion (4) of a vest of the invention showing the underflap (5) and fastener locations (6*a*,6*b*).
Figure 4:
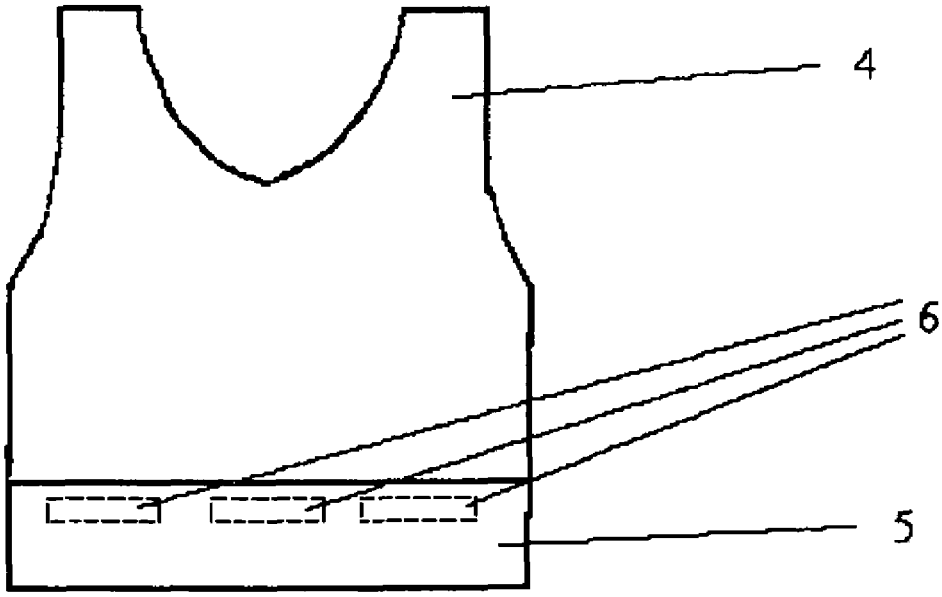
FIG. 4. A plan view drawing of the pouch-facing side of the front inside portion (4) of a vest of the invention showing attached underflap (5) and fastener locations (6).
Figure 5:
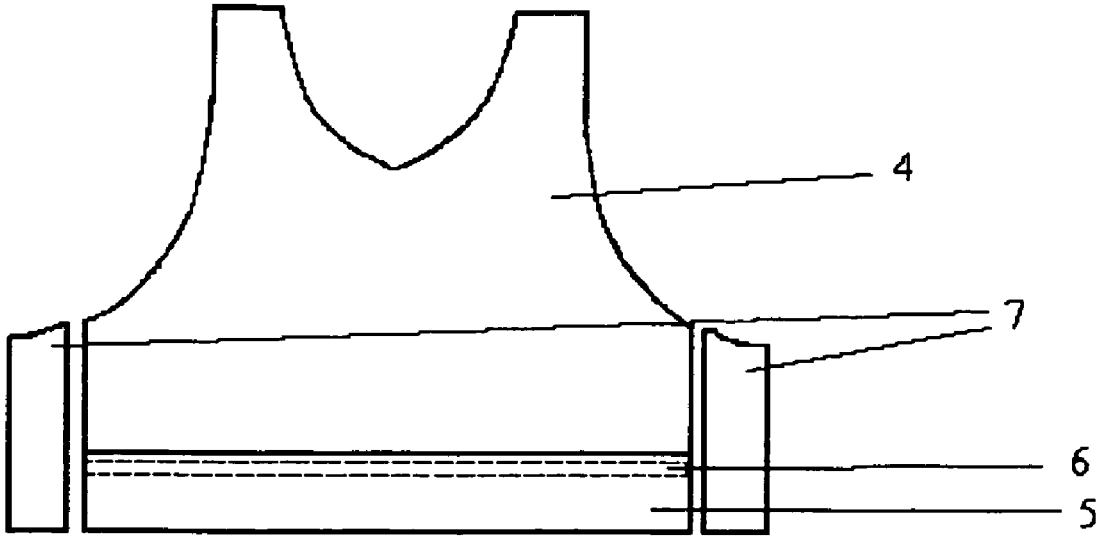
FIG. 5. A plan view drawing of the body facing side of the front inside portion (4) of a vest of the invention showing side extensions (7), as well as underflap (5) and fasteners (6).
Figure 6:
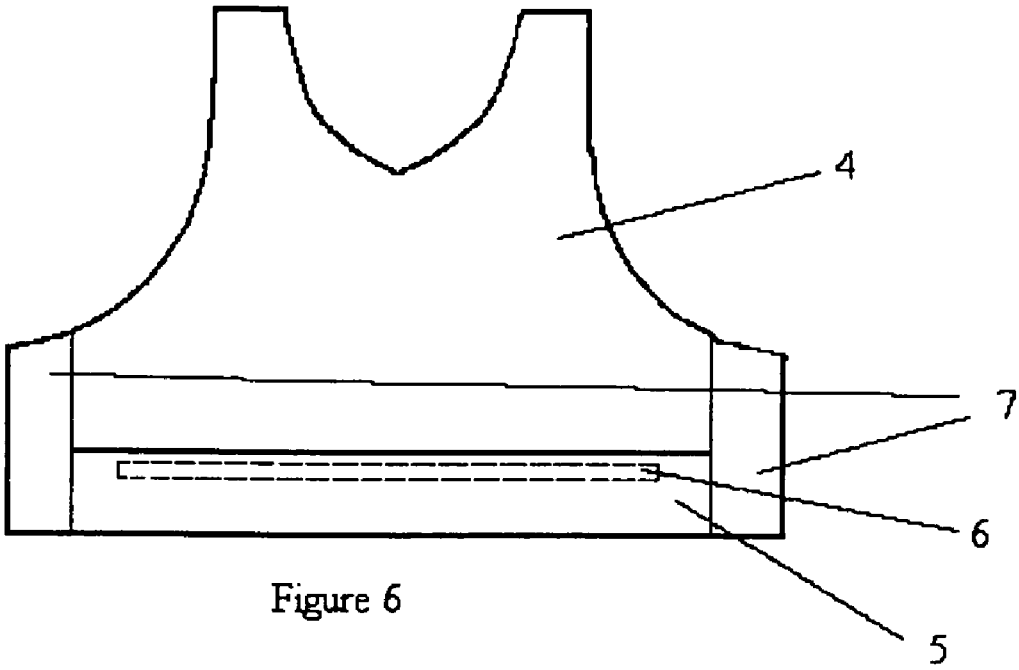
FIG. 6. A plan view drawing of the body-facing side of the front inside portion (4) of a vest of the invention showing fixedly attached side extensions (7), as well as underflap (5) and fasteners (6).

The vest front inside portion is comprised of two sections, an upper section (4) and an underflap (5), of elastic fabric as shown in FIGS. 3 and 4. The two section are attached to one another by at least one fastening means (6). When not attached to one another, the two sections form an opening in the pouch enabling the insertion of at least one ballistic armor insert into the pouch. The fastening means (6) are used to secure the pouch opening. Possible configurations of fastening means (6) are shown in FIGS. 3-6. One portion or portions of the fastening means (6*a*) is fixedly attached near the lower edge of the upper section, and the complementary portion or portions of the fastening means (6*b*) is fixedly attached near the upper edge of the underflap. The complementary portions of the fastening means (6) are located on complementary portions of the upper section (4) and underflap (5) so as to enable convenient joining as shown in FIG. 4. In a preferred embodiment the fastening means (6) is at least one hook and loop fastener strip, such as a VELCRO® strip or the like, where the complementary portions of the fastener are sewn to the upper section (4) and underflap (5) of the front inside portion. As shown in FIG. 3, two hook and loop fastener strips are used, however three or more fastener strips could be used as shown in FIG. 4, or a single hook and loop fastening strip (6) could be used as shown in FIGS. 5 and 6. A single hook and loop strip (6) could be a short strip or it could be a strip covering 50% to 100% of the complementary portions of the upper section (4) and underflap (5). As shown in FIGS. 5 and 6 side attachments (7) are fixedly attached to the side portions of the front inside portion. Preferably the side attachments (7) are sewn to the front inside portion.

Figure 7:
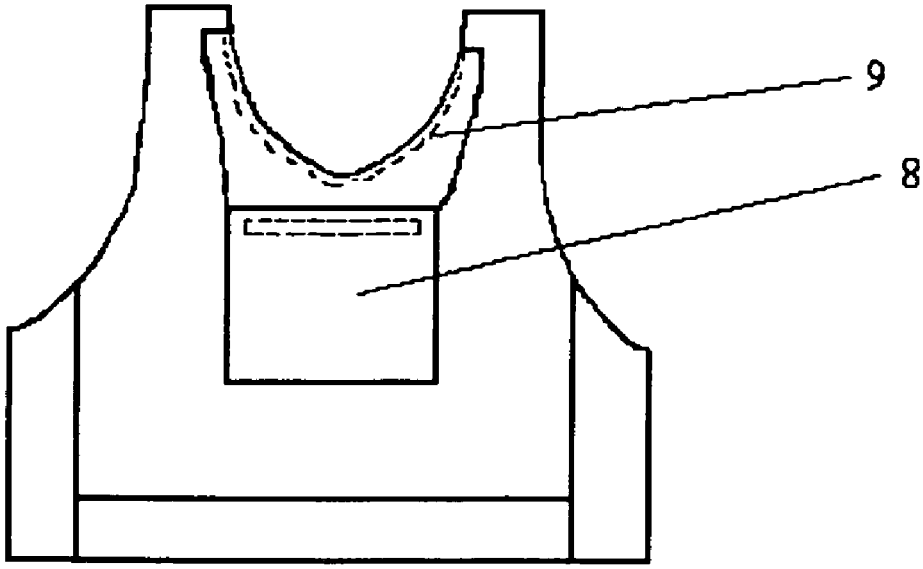
FIG. 7. A plan view drawing of the body-facing side of the front inside portion (4) of a vest of the invention showing second armor pouch (8).
Figure 8A:
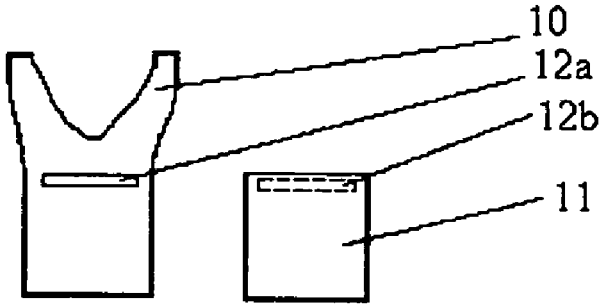
FIG. 8. A drawing of a second armor pouch (8) showing body-facing side of the main pouch portion (10), the body-facing side of the second pouch portion (11), fastener location (s) (12, 12*a*, 12*b*), and a plan view of the body-facing side of an assembled second armor pouch (8).
Figure 8B:
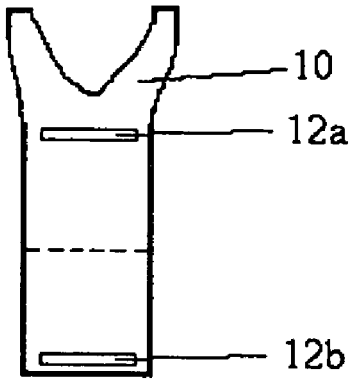
Figure 8C:
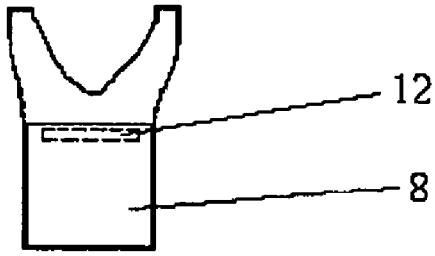

As shown in FIGS. 7, 8A, 8B, and 8C, a second vest front pouch (8) may be formed from two portions of elastic fabric as shown in FIG. 8A, a larger portion 10, with a U-shaped top complementary to the U-shape of the neckline of the vest front, and a smaller rectangular portion 11, complementary in shape to the lower portion of 10. The bottom and both vertical sides of 11 are fixedly attached to 10 to form a pouch for inserting ballistic armor or preferably a trauma plate. Preferably 11 is sewn to 10. A fastening means (12*b*) is fixedly attached near the upper edge of 11, with the complementary portion of the fastening means (12*a*) being fixedly attached opposite on 10. In an alternative embodiment a single piece of fabric (10) may be used as shown in FIG. 8B. Fastening means 12*a* and 12*b* are fixedly attached to the single piece of fabric such that when the fabric is folded along the dotted line the corresponding portions of the fastening means will be in close proximity. The fabric is folded along the dotted line and the two vertical sides are fixedly attached to one another forming a pouch. Preferably the fastening means (12) is at least one hook and loop fastening strip, such as a VELCRO® strip or the like. The fastening means (12) is used to secure the pouch opening and hold ballistic armor or trauma plate within the pouch. Securing the ballistic armor or trauma plate with the fastening means (12) reduces the likelihood of the ballistic armor or trauma plate coming loose or falling out during physical exertion, thus maintaining the ballistic protection of the wearer. The second vest front pouch (8) is fixedly attached to the inside portion of the vest front along the neckline (9) as shown in FIG. 7. Preferably the second pouch is sewn to body-facing side of the inside portion of the vest front.

The first vest front pouch is completed by fixedly attaching the vest front outside portion to the vest front inside portion along the complementary edges. Preferable the edges are sewn together.

Figure 9:
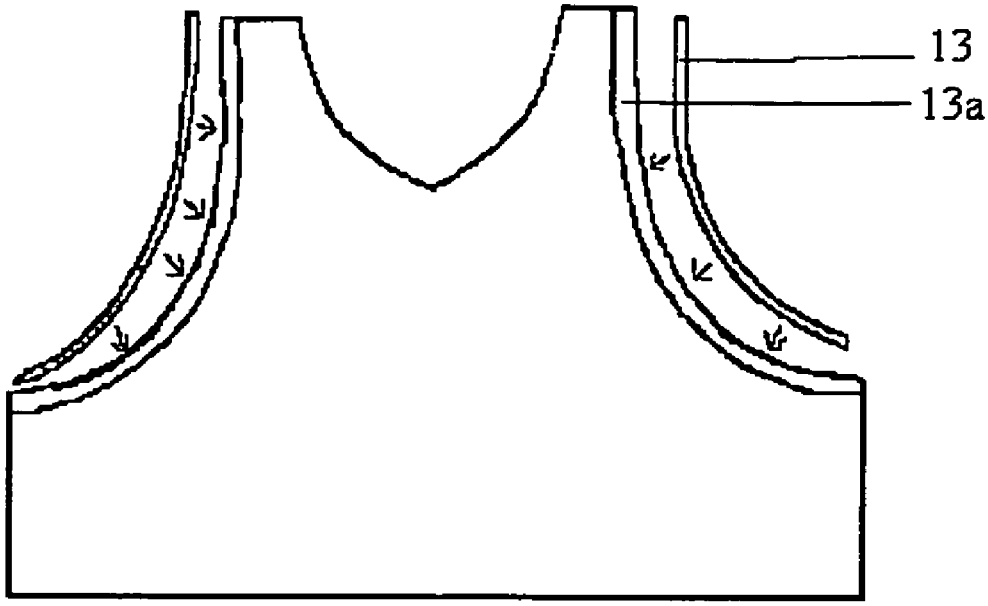
FIG. 9. A plan view drawing of the exterior-facing side of the front outside portion of a vest of the invention showing extra material (13) for women's vests, and the location of attachment (13*a*).

Body armor vests, when worn by women with a generous bust, tend to force breast tissue outwards, towards the arms, and out from under the protection of the vest. The outwards movement of breast tissue leads to unsightly bulging, and exposes a delicate portion of the wearer to danger. In order to address the problem, embodiments of the invention may optionally have breast retention material in the form of extra elastic fabric (13), or elastic strips (13) fixedly attached to the sides of the vest (13*a*), in the area where the wearer's arms project through the vest, as shown in FIG. 9. Preferably the vest front (0) and the extra elastic fabric (13*a*) are a single, contiguous piece of fabric. If the extra fabric is a separate piece of elastic fabric or an elastic strip then the extra elastic (13*a*) fabric is preferably sewn to the vest front. The breast retention material provides support, and firmly holds the wearer's bust in place, acting like a sports bra. The optional breast retention material, of elastic fabric or elastic strips, improves the effectiveness of the vest and the appearance of the wearer.

Figure 10:
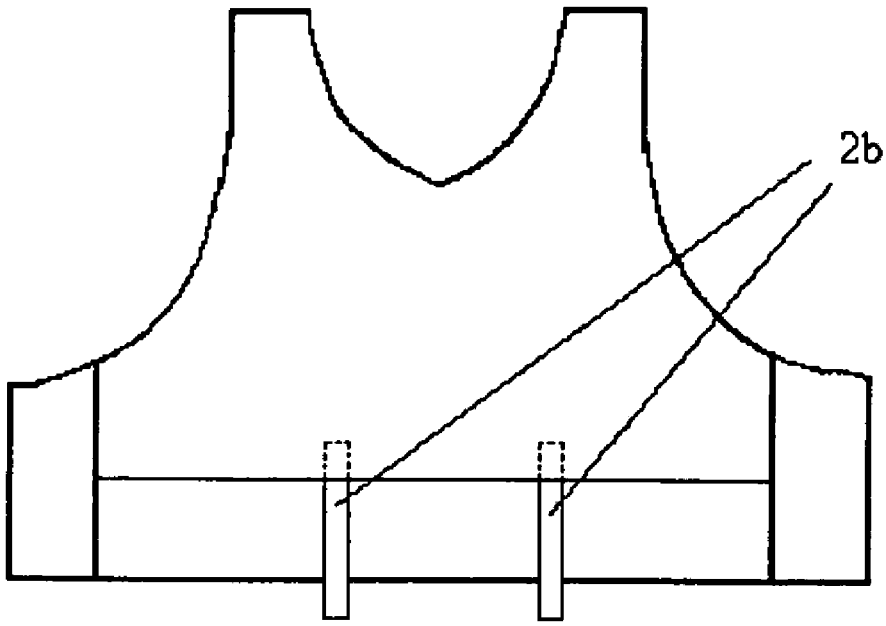
FIG. 10. A plan view drawing of the body-facing side of front inside portion of a vest of the invention showing shelf strap fasteners (2*b*).
Figure 11:
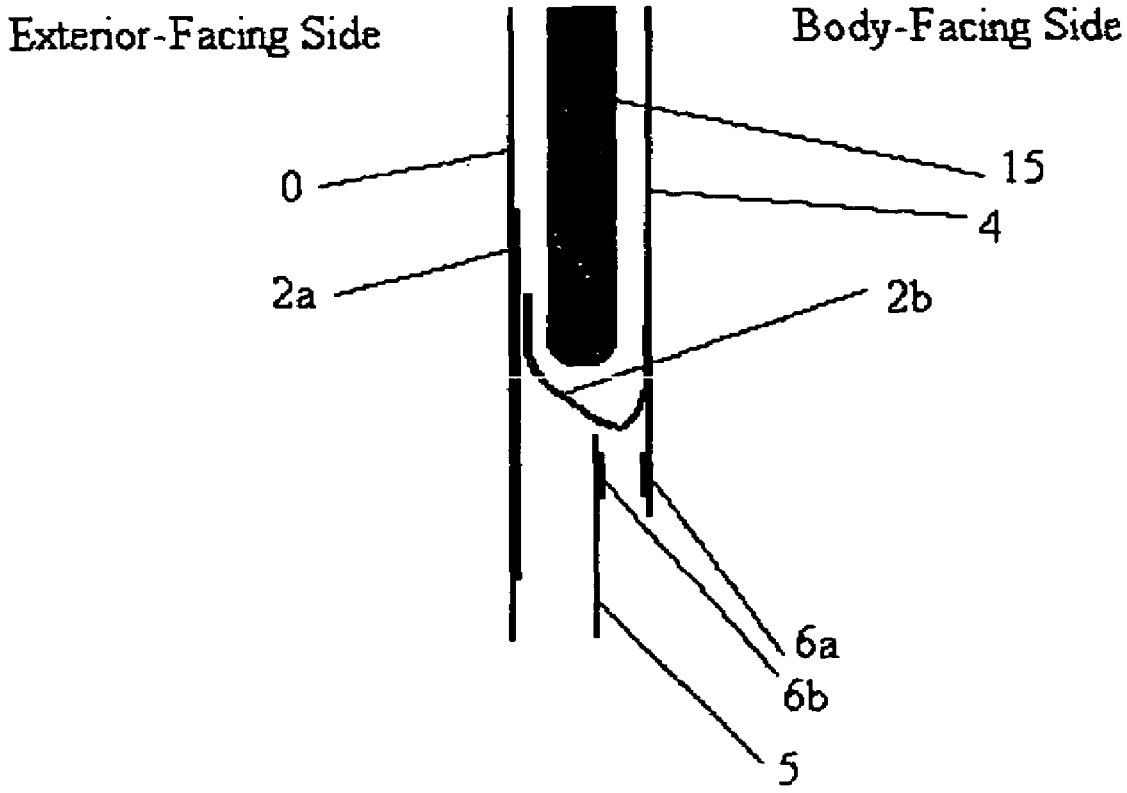
FIG. 11. A side detail view of the front pouch of a vest of the invention showing shelf strap fasteners (2*a*, 2*b*), and body armor (15).

As shown in FIG. 10, one complementary portion of at least two fastening means (2*b*) is fixedly attached to the pouch facing side of the inside front portion of a vest of the invention. The at least two fastening means (2*b*) portions of FIG. 10 are located opposite the fastening means (2*a*) portions which are fixedly attached to the pouch facing side of the front outside portion shown in FIG. 1. Preferably the fastening means are hook and loop fasteners, such as VELCRO® or the like. A detailed side view is shown in FIG. 11. One portion of hook and loop material (2*b*), or a strap to which hook and loop material (2*b*) is fixedly attached, is fixedly attached to the pouch facing side of the inside front portion (4), near the bottom of the upper section of the inside front portion. Preferably a strap formed of hook and loop material (2*b*), or a fabric strap to which hook and loop material (2*b*) is fixedly attached, is sewn near the bottom edge of upper section of the inside front portion, pouch facing side. When a ballistic armor insert is placed within the front pouch the hook and loop strap (2*b*) is drawn underneath the ballistic armor insert and connected to the complementary portion of the fastener (2*a*), securing the ballistic armor insert in place. In other embodiments the strap may be made of fabric, either elastic fabric or non-elastic fabric, and buttons or zippers or metal snap fasteners or other fastening means could be used to attach the strap which is used to hold the body armor insert in place.

Figure 12:
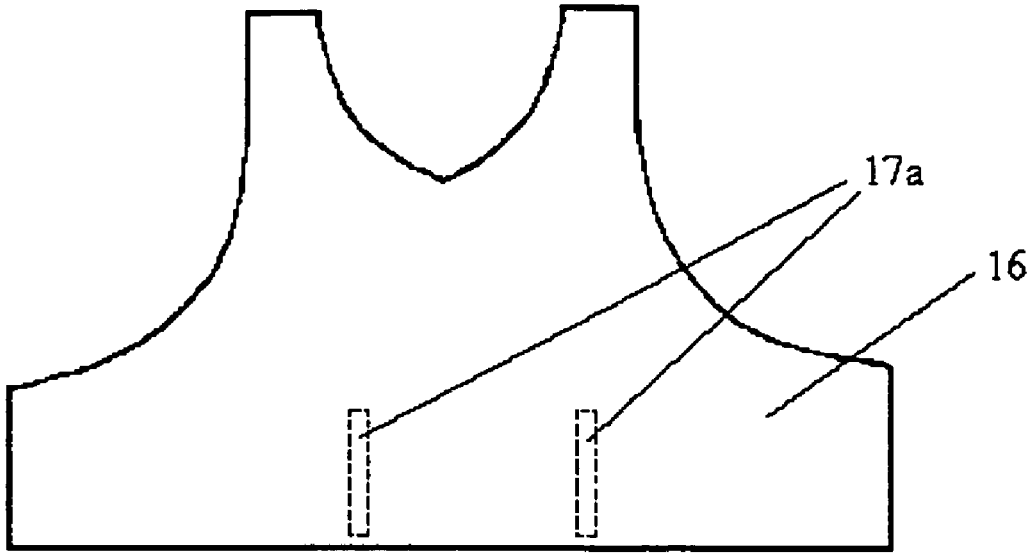
FIG. 12 A plan view of the exterior-facing side of the rear outside portion (16) of a vest of the invention showing the position of shelf strap fasteners (17*a*) located on the pouch-facing side.
Figure 13:
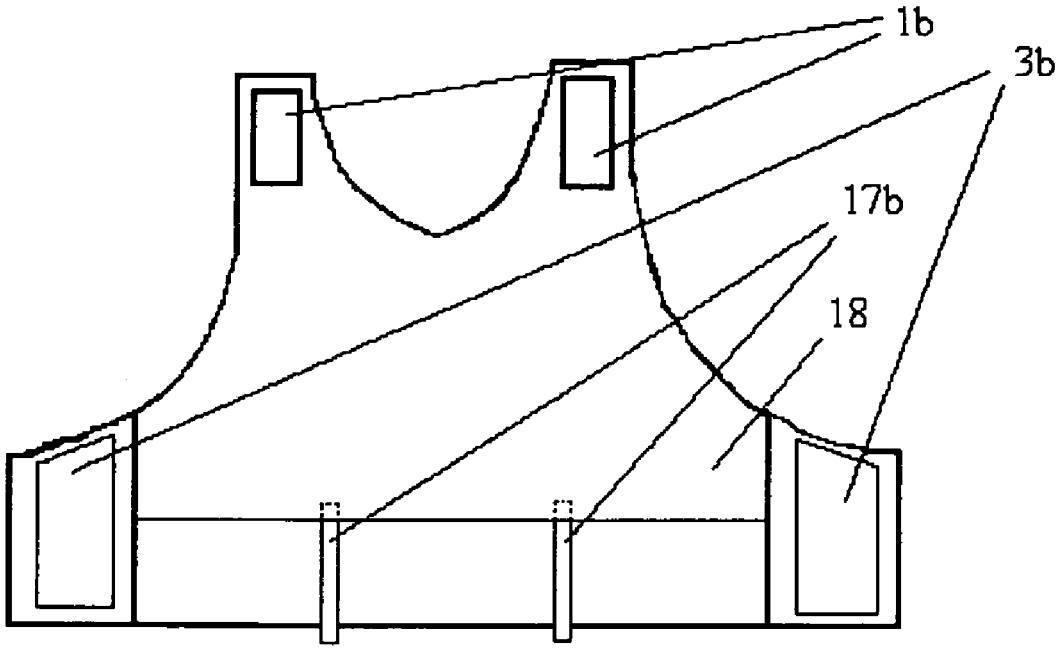
FIG. 13. A plan view of the body-facing side of the rear inside portion (18) of a vest of the invention showing shoulder fasteners (1*b*), waist fasteners (3*b*), and shelf strap fasteners (17*b*).

The vest rear is comprised of a rear outside portion (16), having an exterior-facing side and a pouch-facing side, and a rear inside portion (18), having a body-facing side and a pouch-facing side. One complementary portion of at least two fastening means (17*a*) is fixedly attached to the pouch facing side of the rear outside portion as show in FIG. 12. These fastening means (17*a*) will be used to fasten shelf straps, which are used to secure at least one body armor insert in place in the vest rear pouch. In a preferred embodiment the fastening means (17*a*) are hook and loop fasteners such as VELCRO® or the like. One portion of at least two fastening means (3*b*) is fixedly attached to the body facing side of the rear inside portion of the sides of the vest rear as shown in FIG. 13. The fastening means (3*b*) shown in FIG. 13 are used to secure the vest rear waist to the vest front waist. In a preferred embodiment the fastening means (3*b*) are hook and loop fasteners such as VELCRO® or the like. In a preferred embodiment the hook and loop fastener (3*b*) areas are between about 8 and about 32 square inches, preferably between about 12 and about 32 square inches.

Similar to the front inside portion, the rear inside portion is comprised of two sections of elastic fabric, an upper section and an underflap, as shown in FIGS. 3-6. The two sections are removably attached to one another by at least one fastening means (6). When not attached to one another, the two sections form an opening in the pouch enabling the insertion of at least one ballistic armor panel into the pouch. The fastening means (6) is used to secure the opening of the pouch. Preferably the fastening means (6) comprises a hook and loop fastener. One portion or portions of the fastening means (6) is fixedly attached near the lower edge of the upper section (6*a*), and the complementary portion or portions of the fastening means (6*b*) is fixedly attached near the upper edge of the underflap. The complementary portions of the fastening means are located on complementary portions of the upper and lower fabric sections so as to enable convenient joining of the sections as shown in FIGS. 4 and 13. In a preferred embodiment the fastening means is at least one hook and loop fastener, such as VELCRO® or the like, where the complementary portions of the fastener are sewn to the upper section and underflap of the rear inside portion. Two hook and loop fastener strips may used, similar to the front portion arrangement shown in FIG. 3, however three or more fasteners could be used, as shown in FIG. 4, or a single hook and loop fastening strip could be used. A single hook and loop strip could be a short strip or it could be a strip covering 50% to 100% of the complementary portions of the upper section and underflap, as shown in FIGS. 5 and 6.

As shown in FIG. 13, one complementary portion of at least two fastening means (17*b*) is fixedly attached to the pouch facing side of the inside rear portion of a vest of the invention. The at least two fastening means are located opposite the fastening means (17*a*) fixedly attached to the pouch facing side of the rear outside portion as shown in FIG. 12. Preferably the fastening means (17) are hook and loop fasteners such as VELCRO® or the like. The arrangement of the shelf straps and fastening means are the same as for the vest front pouch, a detailed side view of which is shown in FIG. 11.

Similar to the vest front pouch, the vest rear pouch is completed by fixedly attaching the vest rear outside portion to the vest rear inside portion along the complementary outside edges. The vest rear portion further comprises a complementary portion of a fastening means (1*b*) fixedly attached to the body-facing side of the rear inside portion of each shoulder strap as shown in FIG. 13. The rear shoulder strap fastening means (1*b*) portions are located so as to attach to the complementary fastening means (1*a*) portions fixedly attached to the front outside portion of the shoulder straps of the vest front. The shoulder strap complementary fastening means portions (1) could alternatively be located on the body-facing side of the front inside portion and the exterior-facing side of the rear outside portion of the vest. Therefore, the rear shoulder strap may be located either above or below the front shoulder strap when the two straps are attached. Preferably the fastening means portions (1) are complementary portions of hook and loop fasteners, such as VELCRO® or the like, although complementary button/buttonhole portions, or complementary metal snap fastener portions, or complementary portions of a zipper could be used.

The vest rear further comprises fastening means (3*b*) fixedly attached to the lower sides as shown in FIG. 13. The fastening means (3*b*) are fixedly attached to the body-facing side of the inside portion of the side attachments of the vest rear. The fastening means are complementary to the fastening means (3*a*) fixedly attached to the lower portion of the exterior-facing side of the vest front as shown in FIG. 2. Preferably the fastening means comprise hook and loop fastening means, such as VELCRO® or the like.

Embodiments of the invention may comprise body armor carrier vests wherein the vest front and the vest rear form a single unit connected via the shoulder straps. In vests of this design shoulder strap fasteners are not required since the shoulder straps form a contiguous connection between vest front and vest rear.

Figure 14:
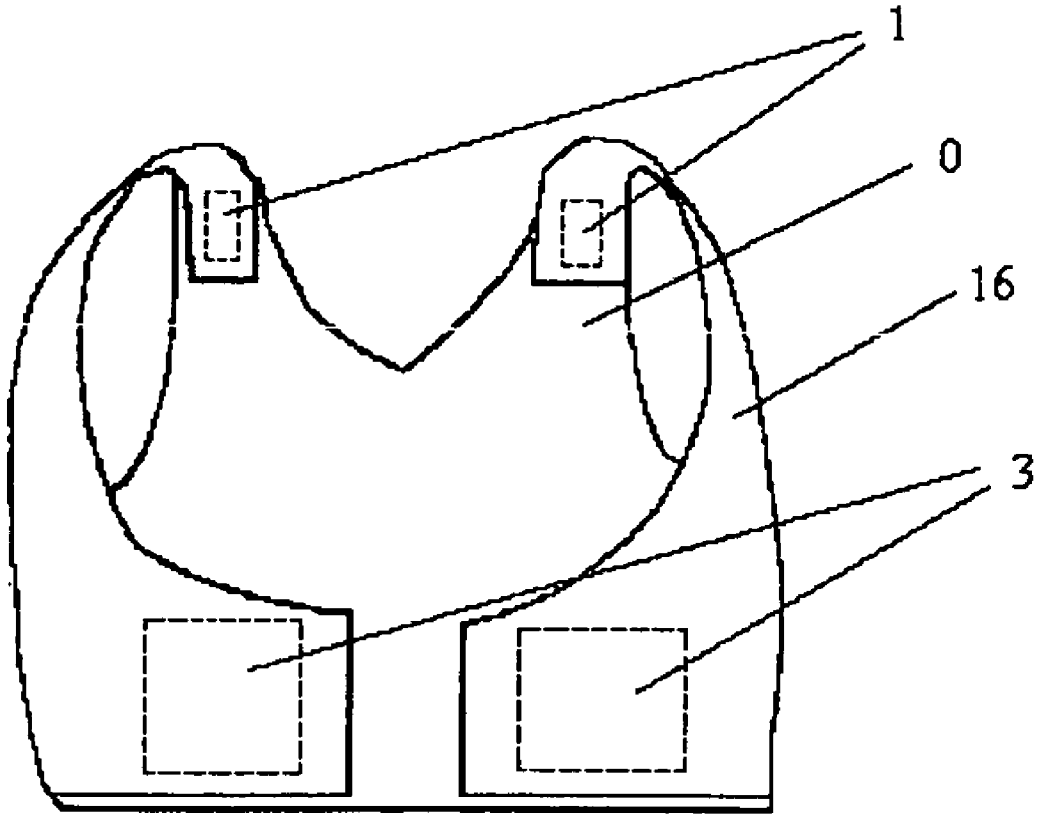
FIG. 14. A front perspective view of the of a vest of the invention showing exterior-facing side of front outside portion (0), shoulder strap fasteners (1), waist fasteners (3), and exterior-facing side of rear outside portion (16).

A perspective view of a vest of the invention is shown in FIG. 14. One way of preparing the vest for use is to place a ballistic armor insert in the first front pouch, insert a ballistic armor insert in the rear pouch, and insert a trauma plate in the second front pouch. Secure the ballistic armor inserts by means of the shelf straps and pouch fasteners. Secure the trauma plate by means of the fastening means located near the top of the second pouch. Attach the front shoulder straps to the rear shoulder straps by using the shoulder strap fastening means. Place the vest on the wearer's body by inserting the wearer's head through the cavity formed by the shoulder straps and allow the shoulder straps to rest on the wearer's shoulders. Attach the rear side attachments to the vest front by the fastening means. Adjust the vest fit by detaching and reattaching the shoulder strap and waist fastening means.

I claim:

1. A body armor carrier vest comprising:
elastic fabric;
a vest front;
the vest front further comprising at least two pouches;
the pouch openings secured with hook and loop fasteners;
the vest front further comprising front shelf straps;
the front shelf straps located in the interior of a vest front pouch;
the shelf straps further comprising hook and loop fasteners;
the vest front further comprising waist hook and loop fasteners;
the vest front further comprising shoulder hook and loop fasteners;
a vest rear;
the vest rear comprising at least one pouch;
the pouch opening secured with hook and loop fasteners;
the vest rear further comprising rear shelf straps;
the rear shelf straps located in the interior of a vest pouch;
the shelf straps further comprising hook and loop fasteners;
the vest rear further comprising waist hook and loop fasteners;
and the vest rear further comprising shoulder hook and loop fasteners.

2. The elastic fabric of claim one further comprising elastic fabric blends.

3. The elastic fabric of claim one further comprising fabric with a 12%-18% stretchability factor.

4. The vest of claim one further comprising breast retention material attached to the front sides of the vest in the region comprising each arm hole.

5. The waist fasteners of claim one further comprising fasteners with an area of about twelve to about thirty-two square inches.

6. The shoulder fasteners of claim one further comprising fasteners about two inches wide and about four to six inches long.

7. The vest of claim one further comprising:
at least one ballistic armor insert in a first pouch of the vest front;
at least one trauma plate in a second pouch of the vest front;
and at least one ballistic armor insert in a vest rear pouch.

8. A vest for carrying ballistic armor comprising:
elastic fabric;
a vest front
the vest front further comprising at least two pouches;
the pouch openings secured with fastening means;
the vest front further comprising front shelf straps;
the front shelf straps located in the interior of a vest fron pouch;

the shelf straps further comprising fastening means;

the vest front further comprising waist fastening means;

the vest front further comprising shoulder fastening means;

a vest rear;

the vest rear further comprising at least one pouch;

the pouch opening secured with fastening means;

the vest rear further comprising rear shelf straps;

the rear shelf straps located in the interior of a vest rear pouch;

the shelf straps further comprising fastening means;

the vest rear further comprising waist fastening means;

and the vest rear further comprising shoulder fastening means.

9. The elastic fabric of claim 8 further comprising elastic fabric blends.

10. The elastic fabric of claim 8 further comprising fabric with a 12% to 18% stretchability factor.

11. The vest of claim 8 further comprising breast retention material attached to the front sides of the vest in the region comprising each arm hole.

12. The vest of claim 8 wherein the fastening means are hook and loop fasteners.

13. The vest of claim 8 further comprising:

at least one ballistic armor insert in a first pouch of the vest front;

at least one trauma plate in a second pouch of the vest front;

and at least one ballistic armor insert in a vest rear pouch.

* * * * *